US005445077A

United States Patent [19]

Dupuy et al.

[11] Patent Number: 5,445,077

[45] Date of Patent: Aug. 29, 1995

[54] INITIATION DEVICE FOR A PYROTECHNIC SYSTEM

[75] Inventors: Jean-Paul Dupuy; Gilles Halin, both of Bourges; Laurent Chauveau, Les Aix d'Angillon; Alain Bonnet, Bourges, all of France

[73] Assignee: Giat Industries, Versailles, France

[21] Appl. No.: 244,564

[22] PCT Filed: Dec. 1, 1993

[86] PCT No.: PCT/FR93/01179

§ 371 Date: Jun. 1, 1994

§ 102(e) Date: Jun. 1, 1994

[87] PCT Pub. No.: WO94/15168

PCT Pub. Date: Jul. 7, 1994

[30] Foreign Application Priority Data

Dec. 18, 1992 [FR] France ..... 92 15314

[51] Int. Cl.[6] ..... F42B 15/34; F42B 39/14

[52] U.S. Cl. ..... 102/481

[58] Field of Search ..... 102/481, 205, 256, 274, 102/221, 254, 260, 258

[56] References Cited

U.S. PATENT DOCUMENTS

| | | | |
|---|---|---|---|
| 4,004,516 | 1/1977 | Johnson et al. | 102/481 |
| 4,709,637 | 12/1987 | Boggero | 102/481 |
| 4,843,965 | 7/1989 | Merzals | 102/205 |
| 5,035,181 | 7/1991 | Jocks et al. | 102/481 |
| 5,035,182 | 7/1991 | Purcell et al. | 102/481 |
| 5,311,820 | 5/1994 | Ellingsen | 102/481 |
| 5,361,703 | 11/1994 | Braithwaite | 102/481 |

FOREIGN PATENT DOCUMENTS

| | | |
|---|---|---|
| 2564965 | 11/1965 | France . |
| 2608265 | 6/1988 | France . |
| 2628833 | 9/1989 | France . |
| 2652644 | 4/1991 | France . |
| 2661725 | 11/1991 | France . |
| 4034630 | 5/1992 | Germany . |
| 1323116 | 7/1987 | U.S.S.R. . |

*Primary Examiner*—Charles T. Jordan
*Attorney, Agent, or Firm*—Oliff & Berridge

[57] ABSTRACT

An initiation device includes a primer-container system placed inside a casing box able to move from a safety position to an armed position through the action of a motor. The system is immobilized in its security position by at least one lock that is released by a shape memory actuator when the surrounding temperature rises above a given value.

12 Claims, 7 Drawing Sheets

INITIATION DEVICE FOR A PYROTECHNIC SYSTEM

BACKGROUND OF THE INVENTION

The scope of the present invention is that of initiation devices for a pyrotechnic system, and more particularly, initiation devices which enable the initiation of the deconfinement of an envelope containing a pyrotechnic charge, such as a propelling charge or an explosive charge.

The function of such deconfinement devices is to ensure the opening of the envelope which contains the pyrotechnic charge when the envelope temperature rises above a certain level.

Such a deconfinement avoids the detonation of the charge resulting from an increase in the envelope temperature.

In fact, when a munition is subjected to a high temperature, for example during the outbreak of a fire in the storage facility, the pyrotechnic charge which is contained within the envelope decomposes.

This decomposition produces gases which in turn cause the pressure inside the envelope to build up. When the conditions of temperature and pressure rise above a certain level, the pyrotechnic charge detonates causing serious damage.

So as to avoid such hazards, it is known to provide means to ensure the opening of the envelope when the temperature rises above a certain level. In fact, the opening of the envelope prevents the build-up of pressure inside it, and the pyrotechnic charge may thereby burn without detonating.

Patents FR2628833 and FR2652644 therefore propose to close the envelope by means of a base whereby the base is made integral with the envelope by means of an eutectic material.

When the temperature rises above a certain level, the eutectic material melts and unlocks the base. The latter is then pushed some distance away from the envelope by means of springs.

Such a device presents certain disadvantages. Where the means of deconfinement are specific to a given munition, they occupy a certain amount of space inside the envelope and may not be removed or replaced without a complicated intervention on the whole of the munition.

It is therefore necessary to design these means during the study phase of the munition and they may not be used to protect older munitions which have not been provided with such devices.

Moreover, as a general rule the eutectic material does not possess all the mechanical characteristics required to ensure a reliable bond between the two elements of the munition during all stages of its operation.

Patent FR2564965 proposes a deconfinement device which is totally external to the munition and which is temporarily fastened onto the latter by means of bands (for example during the different storage phases).

This device comprises a flexible linear shaped charge which is initiated by means of an igniting device comprising a firing pin and a primer. The firing pin is kept away from the primer by a lock in eutectic material.

A rise in temperature causes the eutectic material to melt thereby releasing the firing pin which initiates the primer thereby operating the flexible linear shaped charge.

Such a device also presents certain disadvantages.

For the firing pin to be able to initiate the primer, all the eutectic material must be evacuated from the firing pin housing. However, this material may only be evacuated via a few radial holes which risk becoming blocked during long periods of storage and which are no doubt not sufficient to ensure that all the material is properly evacuated.

The reliability of this device is therefore uncertain.

Moreover, if a deconfinement device, which is not installed on a munition, is subjected to a rise in temperature initiation would still take place at the risk of damage.

This device therefore also provides an insufficient level of safety.

Finally, it must be noted that the eutectic material is placed inside a case and that this case contains a thermal capacity which is likely to disturb the device, notably by modifying the temperature limits for sure functioning.

SUMMARY OF THE INVENTION

An object of the invention is to attenuate such disadvantages, notably by proposing a pyrotechnic system initiation device responding to a rise in temperature, a device which provides an improved level of reliability and safety compared with that of the devices according to prior art.

The invention therefore provides for a safer and more reliable deconfinement device than known devices.

Therefore, an object of the invention is a pyrotechnic system initiation device, comprising a primer-container system placed inside a casing box; a system which is capable of moving from a safety position to an armed position by the action of a motor and the system becoming immobilized in its safety position by at least one lock which is released by a shape memory actuator when the room temperature rises above a certain level.

According to one of the essential characteristics of the invention, the first lock is integral with a rod of which one end projects from the casing box level with a cylindrical housing formed on the latter and the actuator is a shape memory spring placed coaxially at the end of the rod and supported by flange and a band integral with the casing box.

According to another characteristic, the flange is fitted with a sealing ring which enters into contact with an internal surface of the cylindrical housing.

According to another characteristic, the first lock is maintained in the locked position of the primer-container system by means of a maintaining spring which acts in the direction opposite to that of the shape memory spring.

Advantageously, the primer-container system is also immobilized by another lock which is structurally identical to the first lock.

In one particular embodiment, the device comprises a firing pin, pushed against the primer-container system by means of a firing spring, and presenting a collar which comes to rest on an outer surface of the primer-container system, the latter possessing a cylindrical opening of a diameter which is slightly superior to that of the firing pin collar, the opening being coaxial to the primer housing and in line with the firing pin when the primer-container system is in its armed position.

In one particular embodiment, the primer-container system is a rotor and the motor means are composed of a torsional spring placed in an axial bore hole in the rotor and wherein one end penetrates a hole in the rotor and a second end penetrates a hole in the casing box.

Another object of the invention is also a deconfinement device for an envelope containing a propelling or explosive charge, a device which is characterised by the fact that it comprises a separation device for the envelope which are initiated by an initiation device according to the embodiment previously described.

Advantageously, this deconfinement device is characterised in that the primer-container system is immobilized in its safety position by at least two locks, the first lock being released by the shape memory actuator and a second lock which is composed of a catch finger which gives way during the fastening of the device to the envelope.

In one particular embodiment, the catch finger which comprises the second lock is formed with an undercut into which the primer-container system is able to penetrate when released by the first lock and when the catch finger is in the locked position, and the primer-container system is fitted with a stop motion surface which can operate with a collar formed on the catch finger in such a way as to prevent any further giving way of the latter.

The deconfinement device may include structure to enable it to be fastened temporarily on the envelope.

The separation device could be composed of a linear shaped charge designed to be placed along a generating line of the envelope.

BRIEF DESCRIPTION OF THE DRAWINGS

The invention will be better understood after reading the description which follows of a particular embodiment of the invention, a description made according to the drawings given in annexe hereto.

DETAILED DESCRIPTION OF PREFERRED EMBODIMENTS

Figure 1:
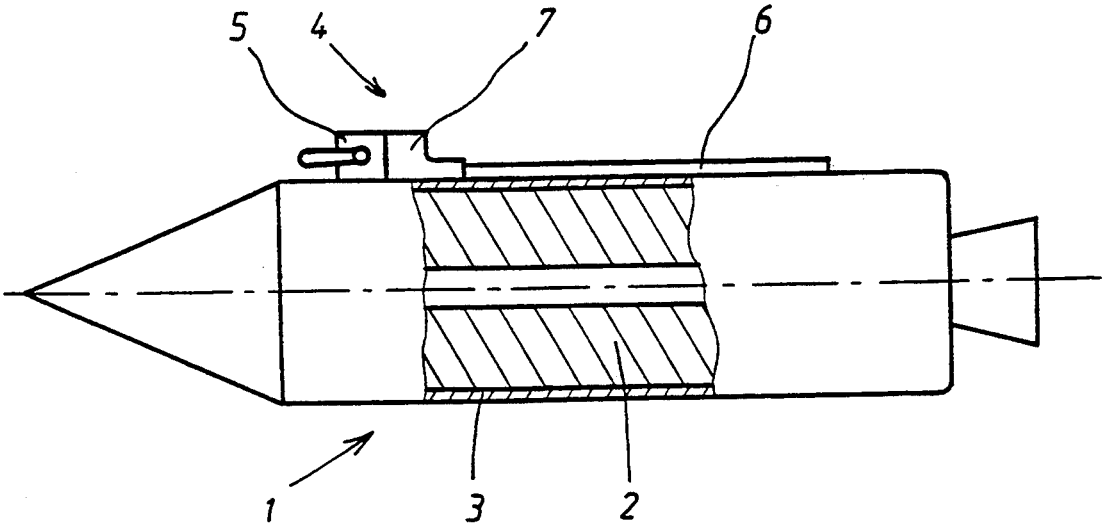
FIG. 1 represents a munition upon which the deconfinement device according to the invention has been fastened.

Referring to FIG. 1, a munition 1 (here an air-to-ground missile), includes a propellant 2 housed inside an envelope 3.

A deconfinement device 4 has been made integral with the envelope 3 of the munition during storage. The device 4 is fastened to the envelope 3 by temporary fastening means 5 which are magnetic means. But any other fastening means could be envisaged, for example a band enclosing the munition and maintained by screws.

The deconfinement device comprises separation means 6, composed here of a flexible linear shaped charge of a known type and an initiation device 7 for the linear shaped charge. The separation means 6 are placed along an external generating line of the envelope 3.

Figure 2A:
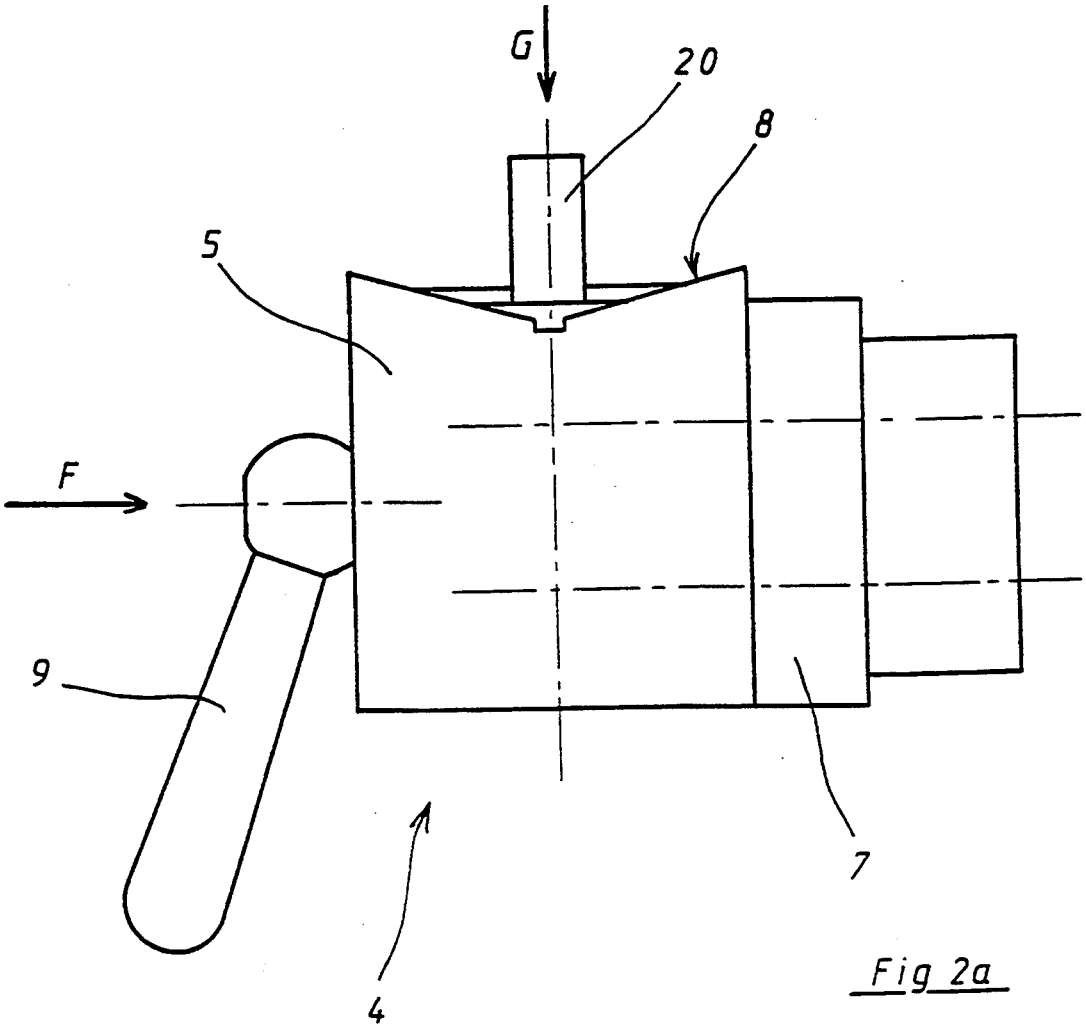
FIGS. 2*a*, 2*b* and 2*c* represent outside views of the deconfinement device according to the invention, FIG. 2*b* being a view following line F as shown on FIG. 2*a*, and FIG. 2*c* being a view following line G as shown on FIG. 2*a*, FIGS. 3*a*, 3*b* and 3*c* represent the initiation device according to the invention in its safety position, FIG. 3*a* being a cross-sectional view along the plane AA the lay out of which is shown in FIG. 2*b* and FIG. 3*c*, FIG. 3*b* being a cross-sectional view following the plane BB as shown on FIG. 3*c* and FIG. 3*c* being a cross-sectional view following the plane CC as shown on FIG. 3*a*, FIGS. 4*a* and 4*b* are analogous to FIGS. 3*a* and 3*b* but show the initiation device in its armed position.
Figure 2B:
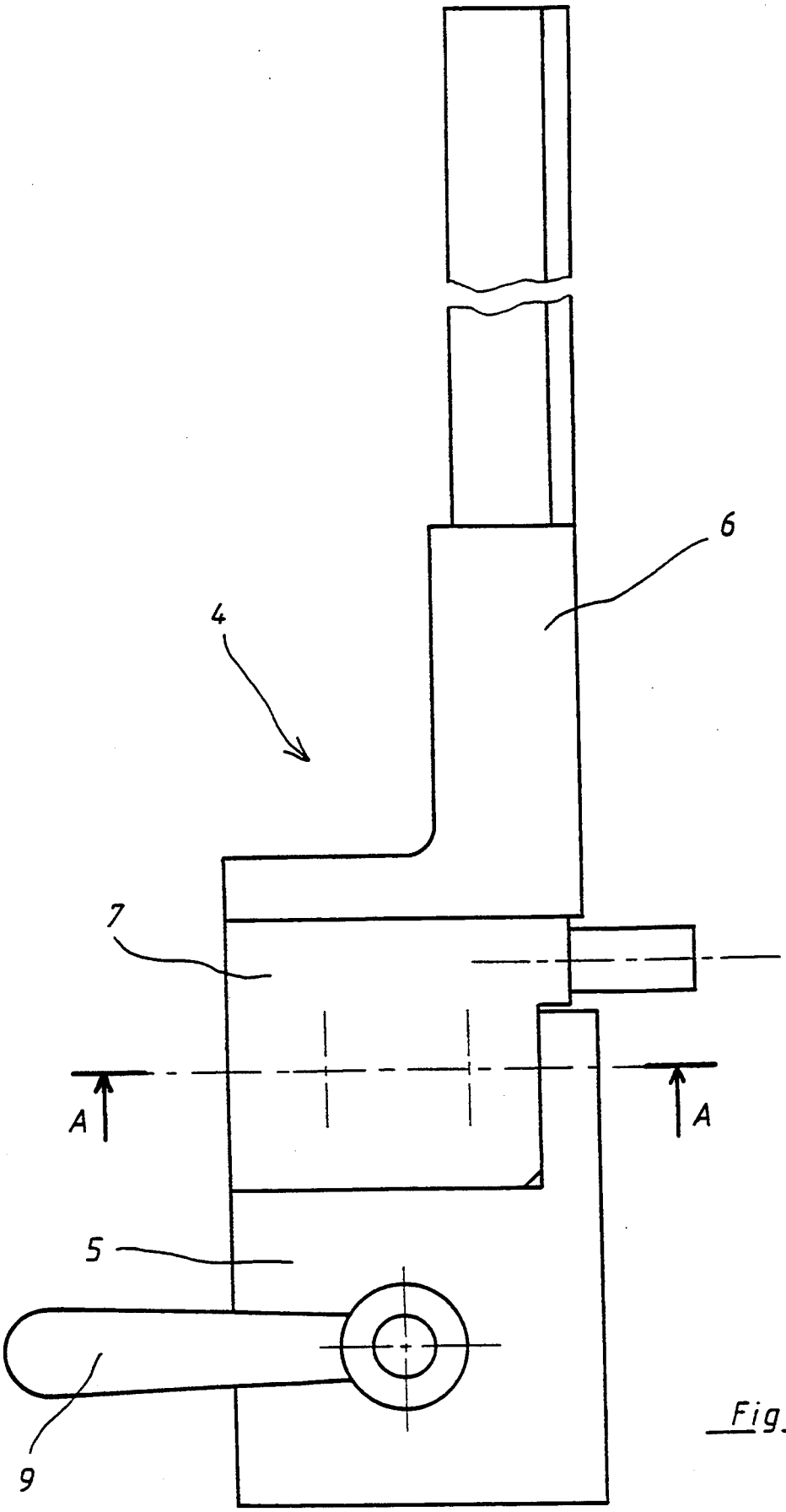
Figure 2C:
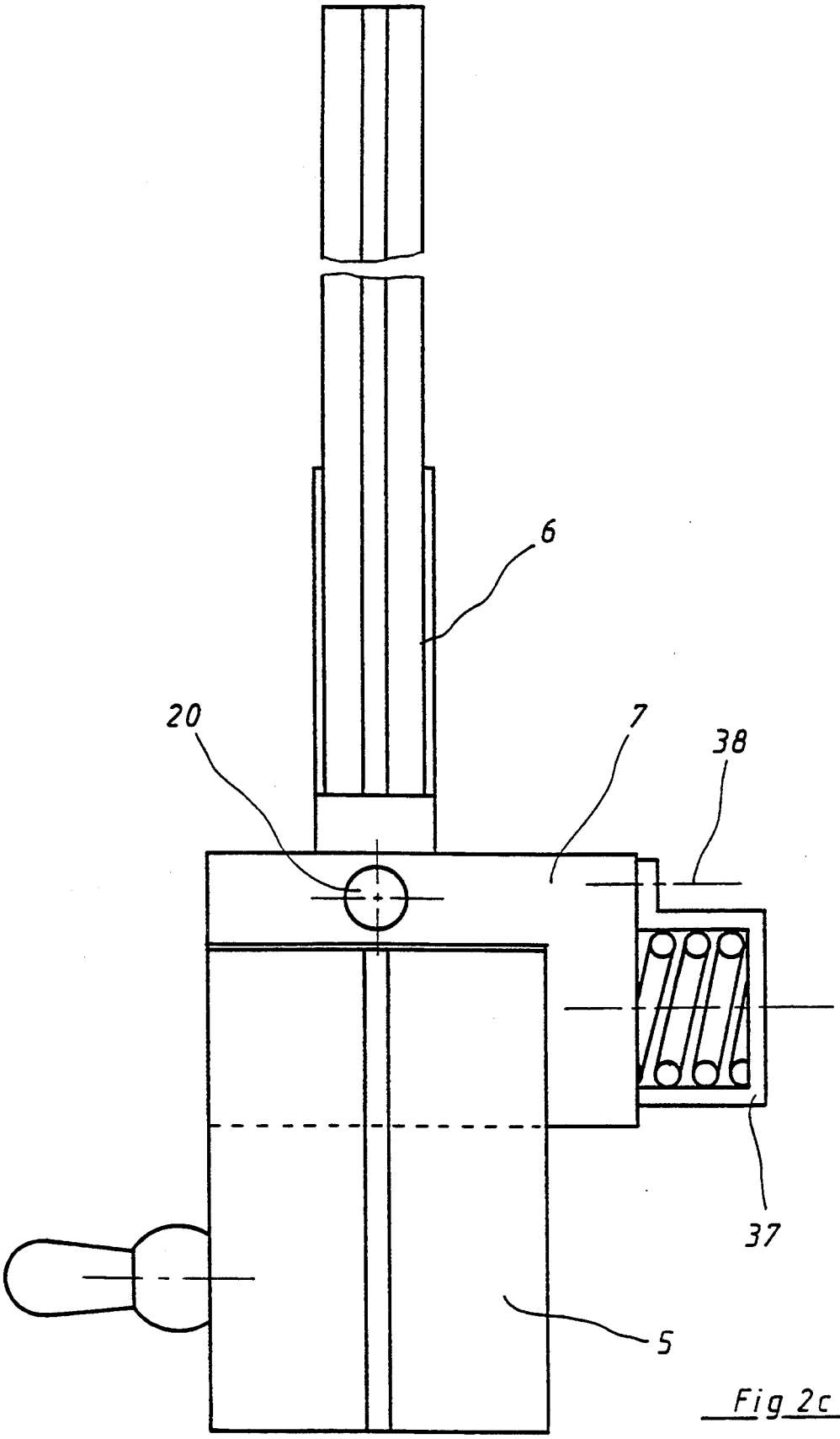

FIGS. 2*a*, 2*b* and 2*c* represent the deconfinement device 4 on a larger scale.

Referring to FIG. 2*a*, the temporary fastening means 5 have a V-shaped profile 8 which is designed to come into contact with the envelope 3 of the munition. A handle 9 is then employed in order to direct as appropriate the magnets (not shown) which are placed inside the fastening means 5.

By using the handle it is possible to make the device 4 integral with the envelope by magnetization and accordingly removing it from the latter.

Referring to FIGS. 2*b* and 2*c*, the initiation device 7 is placed between the temporary fastening means 5 and the separation means 6, these different elements are made integral to each other by appropriate means not shown.

Figure 3A:
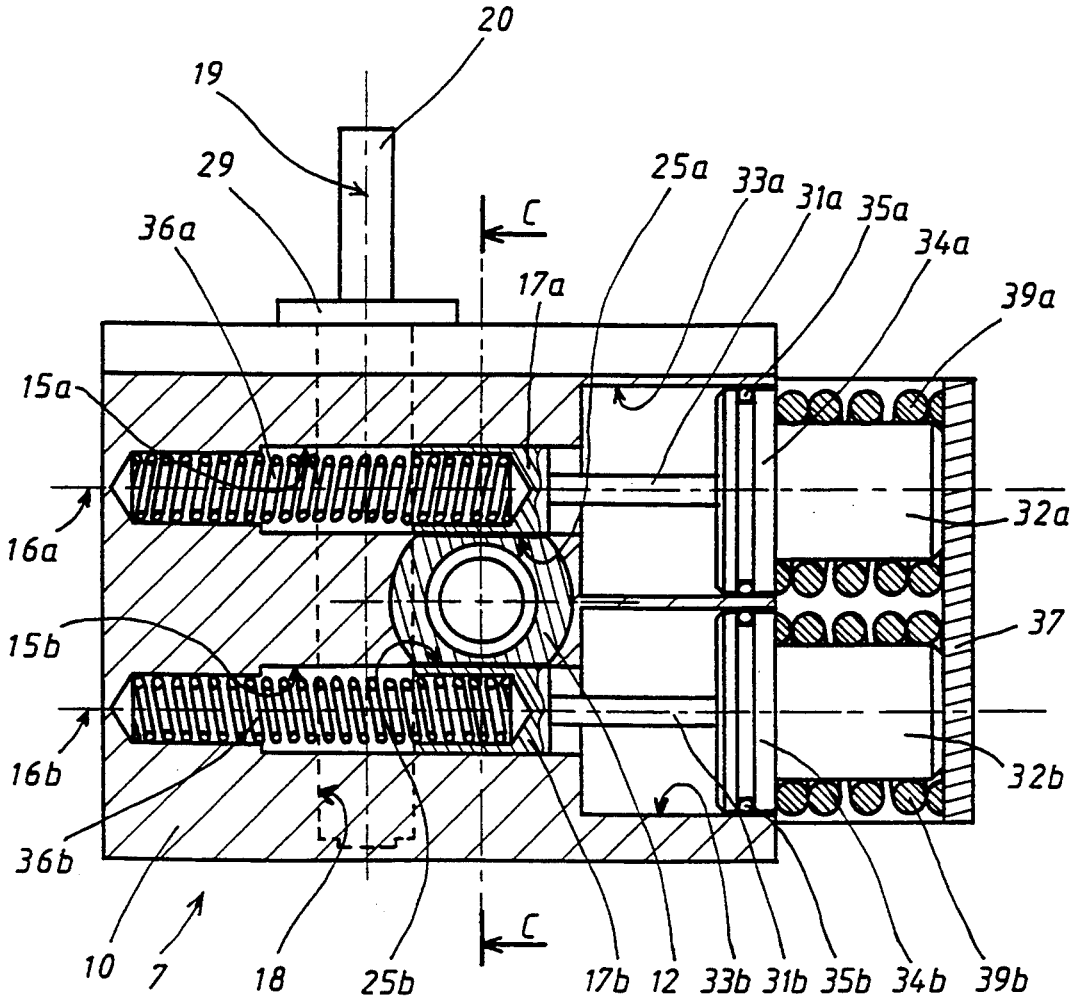
Figure 3B:
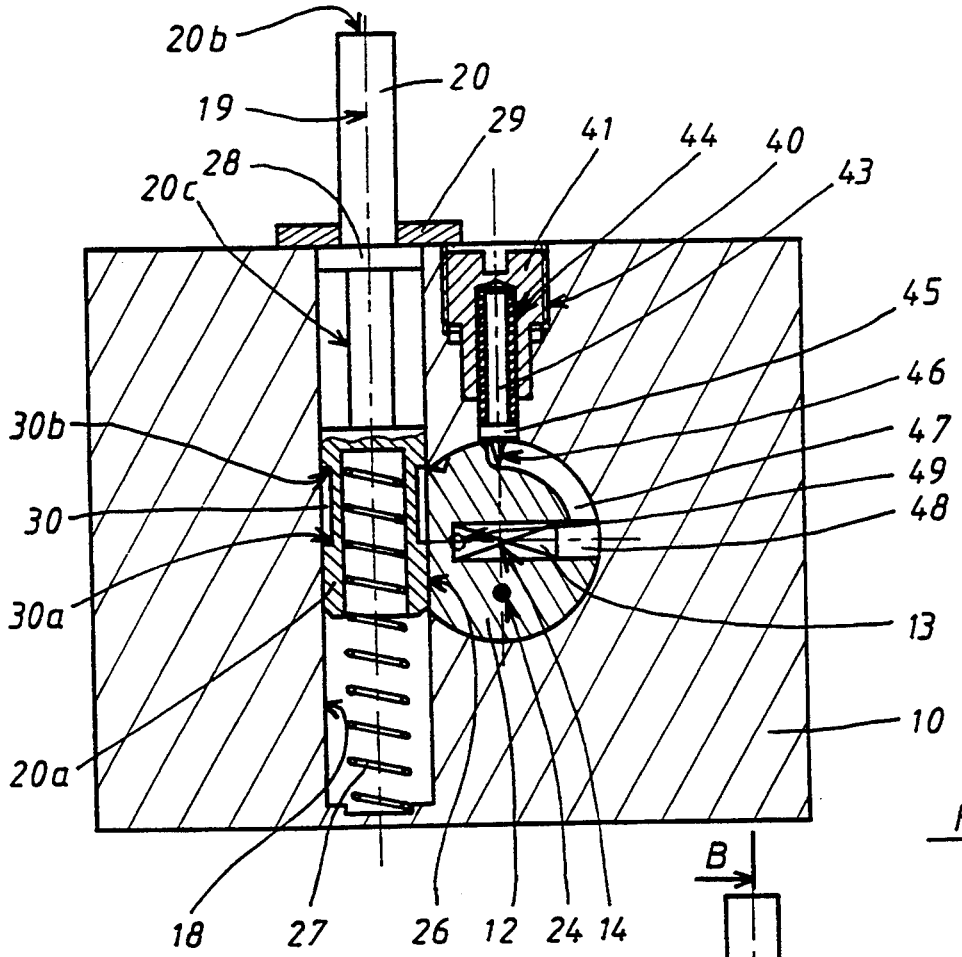
Figure 3C:
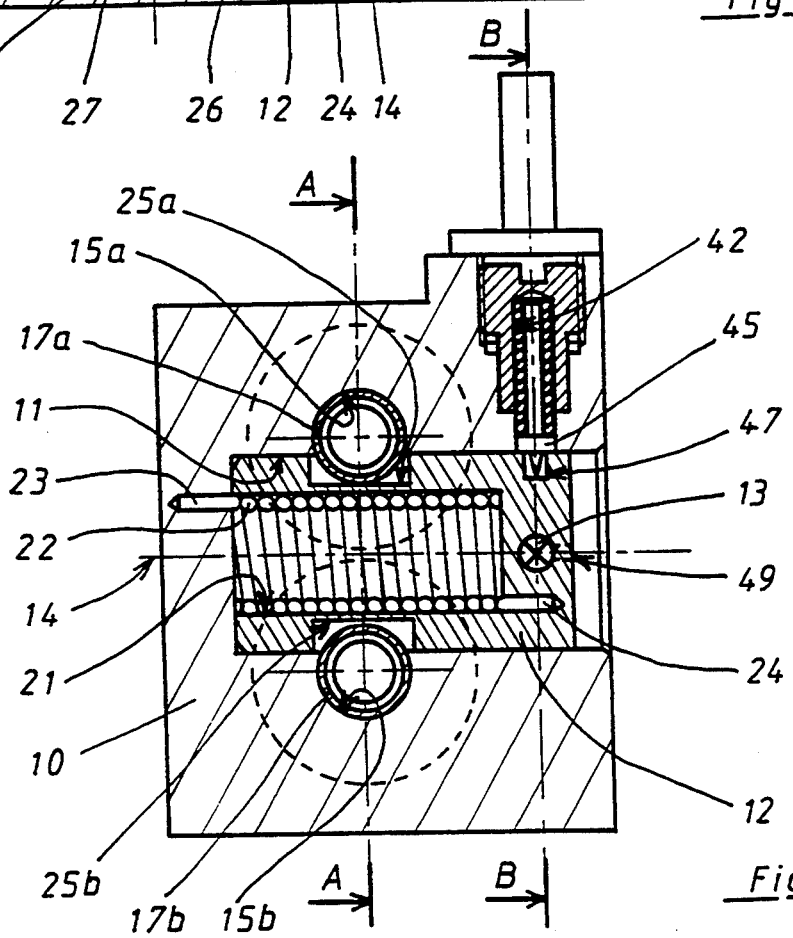

We will now refer to FIGS. 3*a*, 3*b* and 3*c* which represent in detail the initiation device 7 in its safety position.

This device comprises a casing box 10 in a light alloy such as an aluminium alloy, in which a certain number of holes have been bored.

Therein a first bore hole 11 (FIG. 3*c*) is designed to accommodate a primer-container system which is here a rotor 12 holding a primer 13. The axis 14 of this bore hole is roughly parallel to that of the linear shaped charge.

The casing box 10 is also fitted with two bore holes 15*a* and 15*b* which are parallel to each other and wherein the axes 16*a* and 16*b* both lie along a plane AA (of which the outline is visible on FIG. 3*c*), a plane which is perpendicular to the axis 14 of the rotor bore hole 14. The axes 16*a* and 16*b* are both located at an equal distance from axis 14 of the rotor bore hole 11.

The bore holes 15*a* and 15*b* are both designed to accommodate a lock, 17*a* and 17*b* respectively. These locks enable the rotor 12 to be immobilized in a safety position.

The casing box has one final bore hole 18 wherein the axis 19 is located along a plane BB (of which the outline is visible on FIG. 3*c*) a plane which is perpendicular to the axis 14 of the rotor bore hole 11 and which is also parallel to plane AA along which are located the axes 16*a* and 16*b* of bore holes 15*a* and 15*b*.

Bore hole 18 is designed to accommodate a catch finger 20 wherein one end 20*a* constitutes a second lock enabling the rotor 12 to be immobilized in its safety position and wherein the other end 20*b* projects out of the casing box 10.

By turning to FIG. 3*c* the rotor 12 is fitted with an axial bore hole 21 inside of which is placed a cylindrical torsional spring 22. One end of the wire which constitutes this spring penetrates a hole 23 fitted in the casing box and the other end of this wire penetrates another hole 24 fitted in the rotor.

This spring is shown in FIG. 3*c* in its tensed position and it constitutes a motor means designed to move the rotor from its safety position to its armed position.

The rotor includes two flattened surfaces 25*a* and 25*b* which are symmetrical to each other relative to the axis of the rotor 12. These flattened surfaces are designed to operate with the first locks 17*a*, 17*b* so as to prevent any rotation of the rotor 12.

The rotor is also fitted with another flattened surfaces 26 which is designed to operate with the end 20*a* of the catch finger 20 so as to prevent the rotor 12 from moving into its armed position.

The catch finger 20 is pushed towards the outside of its bore hole 18 by a spring 27 which is supported by the bottom of the bore hole 18.

The catch finger 20 is fitted with a collar 28 which butts against a washer 29 fastened by screws (not shown) on the casing box 10. This washer prevents the catch finger from being extracted from its bore hole 18.

Sealing means of a known type and not shown here are placed on the washer and so prevent humidity from entering the device via the bore hole 18. For example an O-type sealing ring could be envisaged integral with the surface of the washer placed towards the inside of the bore hole 18, the ring coming into contact with the cylindrical surface of the catch finger 20.

The end 20*b* constituting the lock is separated from the end 20*a* by a cylindrical part of small diameter 20*c*. The latter is of such a size that when the catch finger is pushed in and finds itself opposite the flattened surface 26, it does not prevent the rotation of the rotor 12.

The bottom end 20*a* of the catch finger 20 is fitted with a circular undercut 30 which is placed in such a way and is of such a size that it allows a slight rotation of the rotor 12 when the first locks 17*a* and 17*b* have been released but when lock 20*a* has not.

The function of such a undercut will be explained later.

For such a rotation to be possible, all that is required (in the catch finger 20 position as shown in FIG. 3*b*) is that the collar 30*b* which limits the undercut 30 on the 20*b* end of the catch finger is not found opposite the flattened surface 26 and that the collar 30*a* which limits the undercut 30 on the other side of the catch finger is situated under the axis 14 of the rotor.

In other words the length of the undercut 30 will be such that the end 20*a* of the catch finger 20 will find itself in contact with the flattened surface 26 over a length which shall be less than half the width of this flattened surface (see FIG. 3*b*).

Referring to FIG. 3*a*, the locks 17*a* and 17*b* are both integral with a rod 31*a* and 31*b* respectively. The rods 31*a* and 31*b* both have a cylindrical end 32*a*, 32*b* which come out of the casing box 10 on a level with the cylindrical housings 33*a*, 33*b*.

The rods are also fitted with flanges 34*a* and 34*b* whose diameter is roughly the same as that of the housings 33*a* and 33*b*.

Each flange has a peripheral groove in which is placed a sealing ring 35*a*, 35*b*. These sealing rings prevent humidity from entering the casing box 10 via the housings 33*a* and 33*b*.

The locks 17*a* and 17*b* are maintained in the rotor 12 locked position by means of maintaining springs 36*a*, 36*b* which are supported by the casing box 10 on a level with the bottom of the bore holes 15*a* and 15*b*.

The maintaining springs 36*a* and 36*b* are radially guided, on the one hand with respect of a housing fitted in each lock 17*a* and 17*b* and on the other with respect of a reduced-diameter zone constituted by the bottom of the bore holes 15*a* and 15*b*.

When the locks 17*a* and 17*b* are in their safety position (as represented in FIG. 3*a*), the ends 32*a* and 32*b* abut against a band 37 in folded sheet metal.

This band is made integral with the casing box 10 by screws, it is also represented in FIG. 2*c* which shows the lay out of the fastening screws (following the axis 38).

The shape memory springs 39*a* and 39*b* are placed around the ends 32*a* and 32*b* of the rods 31*a* and 31*b*. They are supported on the one end by the band 37 and on the other end by the flanges 34*a* and 34*b*. These springs have an inside diameter roughly the same as that of the ends 32*a* and 32*b*.

The materials said to be shape memory apply the shape memory effect possessed by certain alloys of which the most common are Nickel-Titanium and Copper-Zinc-Aluminium/Copper-Aluminium-Nickel.

A shape memory alloy enables mechanical elements to be produced which, after having been subjected to a deformation, recover their original shape as soon as their temperature reaches a certain level. This effect only occurs at a specific temperature which is chosen during the definition of the mechanical element.

The properties of these alloys are well known.

In order to produce the springs 39*a* and 39*b* a material of the Titanium/Nickel type presenting the following characteristics may be used:

Initial temperature: As=130° C.
Final temperature: Af=140° C.
Young Module: $9\times10^4$ MPa
Specific heat: $3\times10^5$ J. ° $K^{-1}$ .$m^{-3}$
Thermal conductivity: 10 J. ° $K^{-1}$ .$m^{-1}$ .$s^{-1}$
Density: 6400 to 6500 kg/$m^3$ So as to avoid all loss of heat by thermal conduction and in so doing to make the functioning of the device more reliable the ends 32*a* and 32*b* as well as the flanges 34*a* and 34*b* will be covered with a heat insulating coating such as TEFLON (Trade mark designating polytetrafluorethylene).

Because of their position outside the casing box 10, the springs 39*a* and 39*b* provide a large surface area which is in contact with the room temperature and which will rapidly be able to detect excessive overheating of the air surrounding the munition.

Referring to FIGS. 3*b* and 3*c*, the casing box 10 is fitted with a screw thread 40 designed to accommodate a screw plug 41.

This screw plug has a bore hole 42 inside of which is placed a firing pin 43 and a firing spring 44. The firing spring 44 is supported on the one hand by the bottom of the bore hole 42 and on the other by a collar 45 of the firing pin.

The tip 46 of the firing pin comes into a groove fitted on the rotor 12. The groove 47 extends over roughly one quarter of the periphery of the rotor, and its width is less than that of the collar 45.

Thus the spring 44 pushes the firing pin 43 towards the rotor and the collar 45 comes to rest on the outer surface of the rotor,.

The groove 47 runs into a cylindrical opening 48 which lies coaxially to the primer 13 and whose diameter is greater than that of the collar 45.

When the rotor has been able to make a quarter turn, the firing pin 43 finds itself released by the opening 48 and it can therefore initiate the primer 13.

The functioning of this device is as follows.

When the deconfinement device is not placed on a munition, it is found in its safety position such as is represented in FIGS. 2*a*, 2*b*, 2*c*, 3*a*, 3*b*, 3*c*. The rotor is therein maintained in its safety position (primer and firing pin not aligned), by three locks: the first two locks 17*a*, 17*b* and the second lock 20*a*.

The catch finger 20 is found level with the surface of the device which is designed to come into contact with the envelope of the munition.

Therefore when the device is installed on a munition, the catch finger 20 finds itself pushed in by the munition.

In this pushed-in position the end 20*a* which constitutes a lock is now released and the cylindrical part 20*c* is brought opposite the flattened part 26.

The catch finger 20 can therefore no longer prevent the rotor from rotating.

Figure 4A:
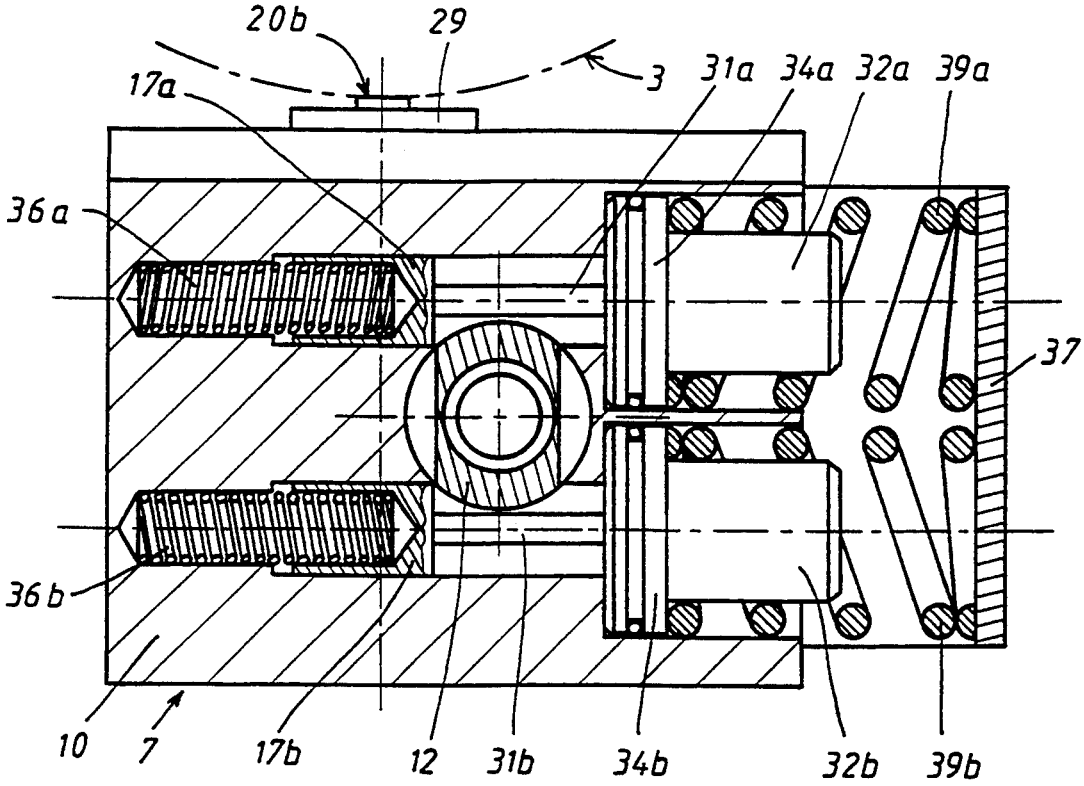
Figure 4B:
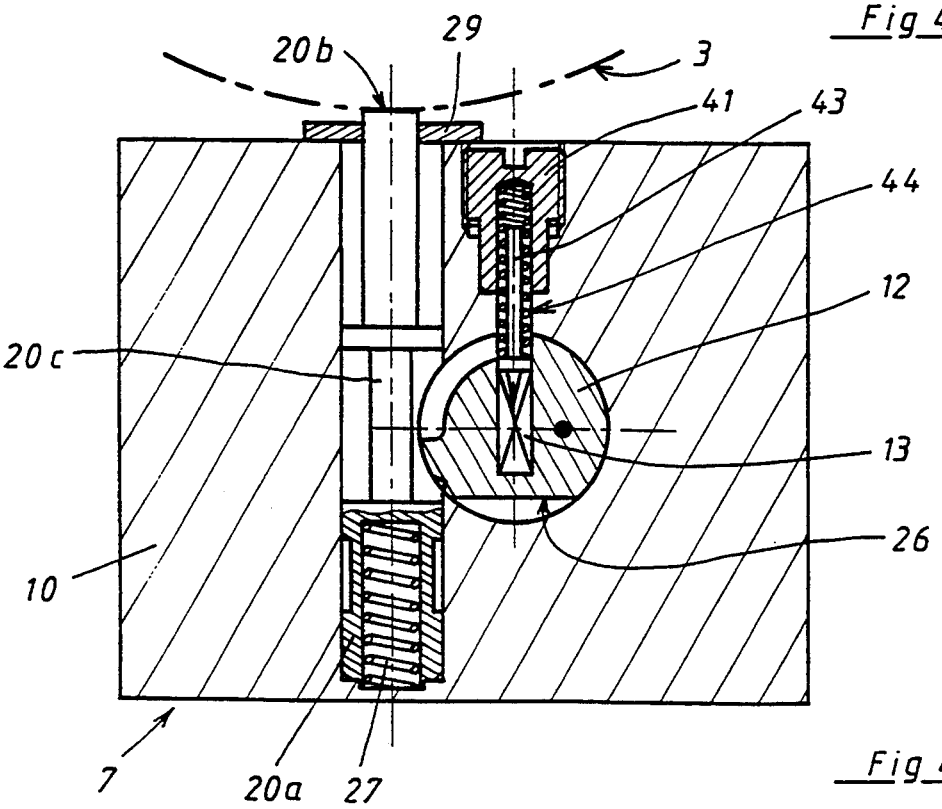

FIGS. 4*a* and 4*b* show the initiation device in its firing position.

It is nevertheless possible to see in FIG. 4*b* the position adopted by the catch finger 20 when the device is installed on a munition wherein the envelope 3 is represented by a broken line.

During installation on the munition a rotor lock is therefore automatically withdrawn.

The rotor is however still immobilized by the first locks 17*a* and 17*b*.

When the temperature outside the envelope reaches the limiting value envisaged during the definition of the shape memory springs, the latter transform their state.

They push the first locks 17*a* and 17*b* by means of the flanges 34*a*, 34*b* and the rods 31*a*, 31*b*. This pushes against the action of the springs 36*a* and 36*b*.

The effect of this movement is to release the rotor which is drawn by its motor means (the torsional spring 22) into its armed position.

As soon as the rotor reaches its armed position, the firing pin 43, pushed by its spring 44, initiates the primer 13 which causes in turn the flexible linear shaped charge to be initiated.

The initiation of the flexible linear shaped charge is carried out by means of a primer relay of a known type and not represented here. This relay is integral with the separation means 6 and it is placed near an orifice 49 fitted in the rotor (see FIGS. 3*b* and 3*c*) and which opens a passage from the primer 13 housing and the separation means 6, only when the rotor is in its armed position.

The use of shape memory actuators (here shape memory springs) enables an initiation device (and therefore a deconfinement device) to be obtained which presents a level of precision and reliability which have been considerably improved compared with systems according to prior art.

In fact the shape memory actuators ensure the transformation of the state of the device in response to the temperature with a precision of somewhere in the order of ±10° C., and this transformation, thanks to the invention, enables a simple and reliable mechanical device to be armed.

By adopting two locks each operating with a shape memory spring the safety of the initiation device may be further increased.

The presence of the other lock which gives way during the installation of the device on the munition provides a deconfinement device with an exceptional safety level.

In fact, if the shape memory actuators are activated in the absence of a munition, for example during the storage of the deconfinement devices on their own, the rotor remains blocked by the catch finger 20 and the flexible linear shaped charge as well as the other pyrotechnic elements are not initiated.

According to another characteristic, the device according to the invention is able to neutralize itself with respect to its shape memory springs if they are subjected to an accidental thermal aggression.

Figure 5A:
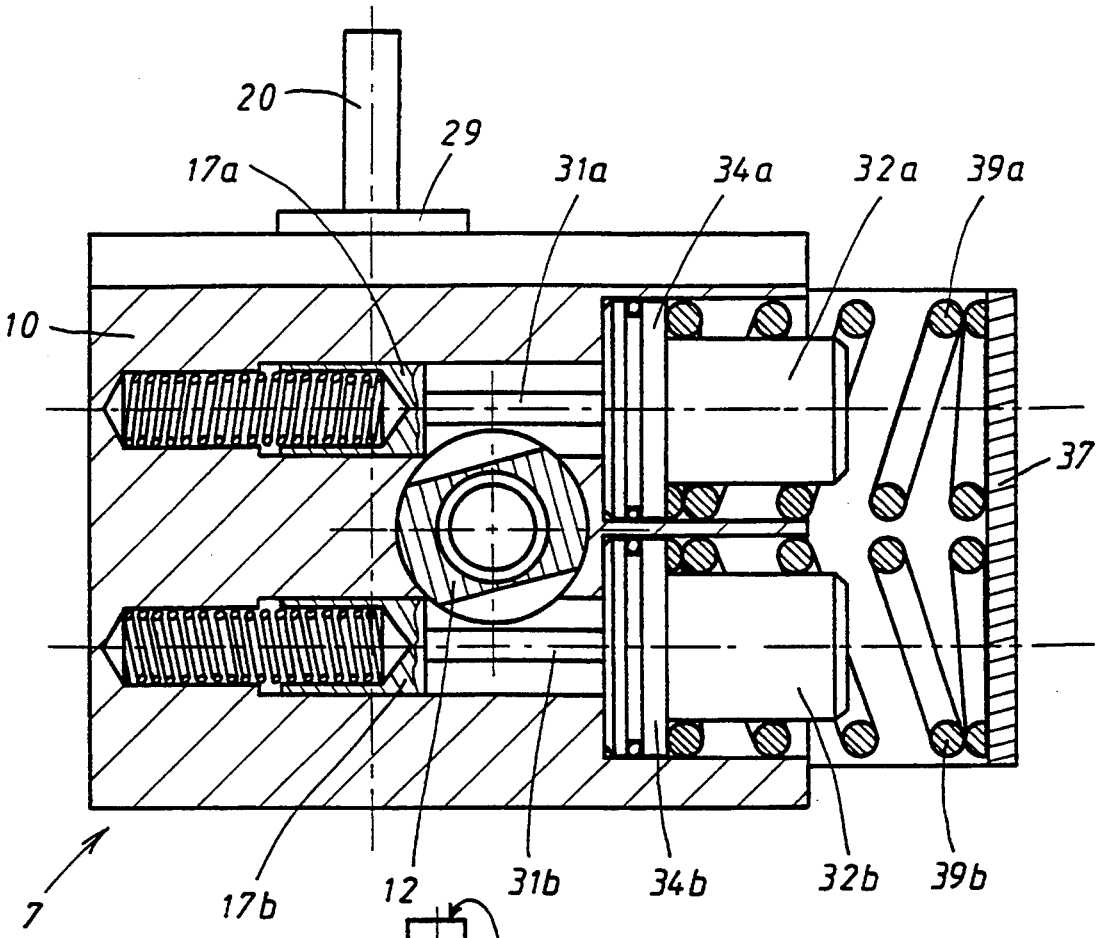
FIGS. 5*a* and 5*b* are analogous to FIGS. 3*a* and 3*b* but shown the initiation device in its neutral position.
Figure 5B:
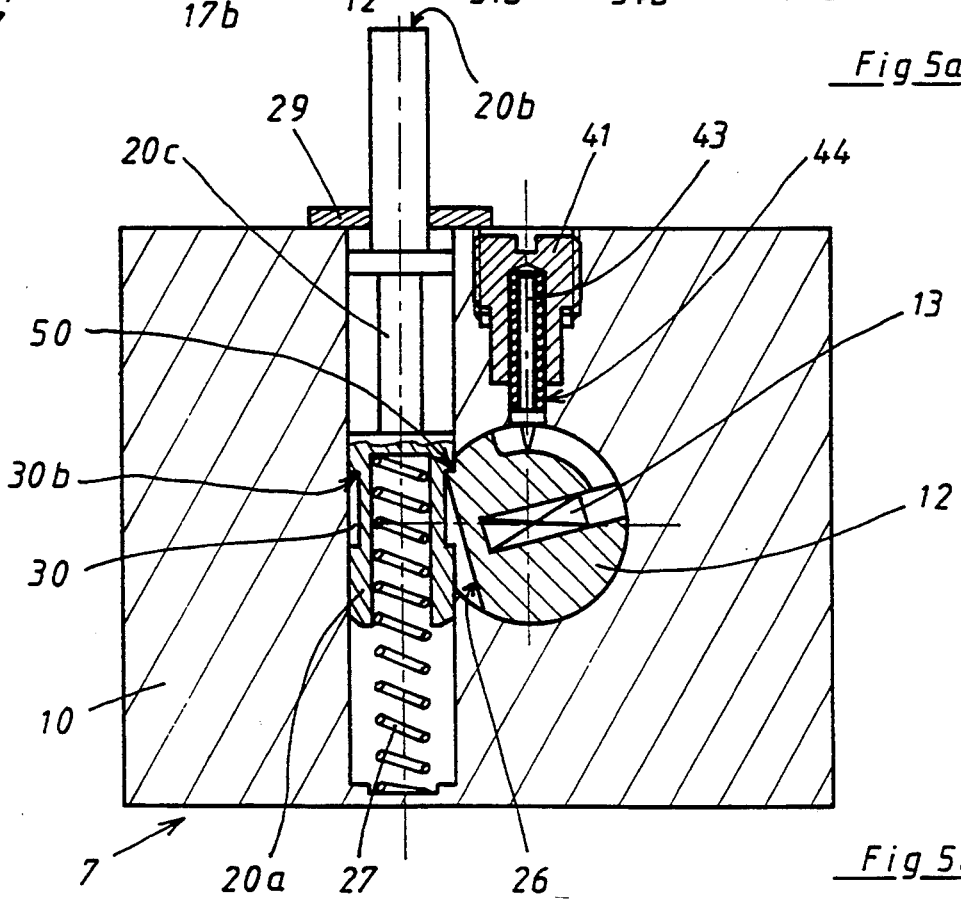

FIGS. 5*a* and 5*b* represent the initiation device 7 in it neutralization position.

The shape memory springs 39*a* and 39*b* have been transformed during storage of the device. They have therefore pushed the locks 17*a* and 17*b* and the latter have released the rotor 12.

Because of the presence of the circular undercut 30, the rotor has been able to begin its rotation until coming to abut against the catch finger 20 on a level with the circular undercut 30 (see FIG. 5*b*).

The rotor is maintained in this position by its motor means (the torsional spring 22). The rotor is fitted with a notch 50 which constitutes a stop motion surface for the collar 30*b* which limits the circular undercut 30 of the catch finger 20.

In such a configuration it is impossible to push in the finger 20, the deconfinement device can therefore no longer be installed on a munition or be initiated during an attempt to install it on a munition.

Such a provision increases the safety and reliability of the device even further since only those devices which have suffered no damage to their shape memory actuators may be operationally employed.

Other variations are possible without leaving the scope of the invention.

Therein it is possible to replace the flexible linear shaped charge by a flexible ring shaped charge encircling the envelope of the munition.

It is also possible to supply several charges with a single initiation device.

It is possible to envisage only one shape memory spring operating a single first lock 17.

The shape memory actuator could be of a different shape, the band 37 could be composed of a shape memory material and push directly on the end 32 of a rod 31 during its transformation.

Lastly it is possible to define an initiation device in which the primer-container system is not a rotor but a slide valve which is able to translate relative to the casing box from a safety position to an armed position through the action of motor means (for example one or several springs).

In this event, the locks and the neutralization means may be structured in a similar way to those previously described.

The deconfinement device according to the invention may be used to fragment the envelope of a missile-type munition (mainly with respect to its propeller). It may also be used to fragment the envelope of an explosive munition such as an aerial bomb.

The deconfinement device according to the invention may also be designed to be installed permanently on the munition.

The initiation device according to the invention may lastly be used, in response to a rise in temperature, to activate a pyrotechnic system other than the deconfinement device described hereabove.

It may for example be used to open partitions or panels to enable people to be evacuated from a building in an emergency. It may also be used to trigger the automatic closing of fire doors in buildings or on ships.

It may also be used to set off automatic fire extinguishing systems or to fire off signalling rockets thus enabling outbreaks of fire in outlying forest areas to be monitored.

We claim:

1. An initiation device for a pyrotechnic system, comprising a movable primer-container housing a primer and disposed inside a casing box, said primer-container being operatively coupled to a motor for movement from a safety position to an armed position in which the primer is automatically initiated, the primer-container being operatively coupled to a first lock in the safety position, thereby being immobilized in the safety position, said first lock being operatively coupled to a shape memory actuator, said shape memory actuator releasing the immobilization of said primer-container when a surrounding temperature rises above a given value.

2. An initiation device according to claim 1, wherein the first lock is integral with one end of a rod exiting said casing box from a cylindrical housing fitted on said casing box, wherein said shape memory actuator is a shape memory spring, said spring being disposed coaxially along the end of the rod exiting said casing box, one end of said spring abutting a flange and the other end of said spring abutting a band integral with the casing box.

3. An initiation device according to claim 2, wherein the flange comprises a sealing ring engaging an inside surface of the cylindrical housing.

4. An initiation device according to claim 2, wherein the first lock is maintained in the safety position of the primer-container by a maintaining spring which acts in an opposite direction to that of the shape memory spring.

5. An initiation device according to claim 1, wherein the primer-container is immobilized by a second lock similar to the first lock.

6. An initiation device according to claim 1, further comprising a firing pin urged against the primer-container by a firing spring and fitted with a collar, said collar resting on an outside surface of the primer-container, wherein the primer-container comprises a cylindrical opening having a diameter greater than that of the collar and which is coaxial to primer housing and is in line with the firing pin when the primer-container is in the armed position.

7. An initiation device according to claim 1, wherein the primer-container comprises a rotor and wherein the motor comprises a torsional spring disposed in an axial bore hole of the rotor wherein one end of said torsional spring penetrates a hole in the rotor and another end penetrates a hole in the casing box.

8. A deconfinement device for an envelope containing a charge, the device comprising separation means for the envelope initiated by an initiation device comprising a movable primer-container housing a primer and disposed inside a casing box, said primer-container being operatively coupled to a motor for movement from a safety position to an armed position in which the primer is automatically initiated, the primer-container being operatively coupled to a first lock in the safety position, thereby being immobilized in the safety position, said first lock being operatively coupled to a shape memory actuator, said shape memory actuator releasing the immobilization of said primer-container when a surrounding temperature rises above a given value.

9. A deconfinement device according to claim 8, wherein the primer-container is immobilized in the safety position by a plurality of locks, the first lock being released by the shape memory actuator and a second lock constituted by a catch finger which is displayed by the device being fastened on the envelope.

10. A deconfinement device according to claim 9, wherein the catch finger comprises an undercut inside which the primer-container can penetrate when it is released by the first lock and the catch finger is in a locked position, and wherein the primer-container is fitted with a stop motion surface operating with a collar on the catch finger so as to prevent any further displacement of the catch finger.

11. A deconfinement device according to claim 8, further comprising fastening means to temporarily fasten said deconfinement device to the envelope.

12. A deconfinement device according to claim 8, wherein the separation means comprises a flexible linear shaped charge disposed along a generating line of the envelope.

* * * * *